US005360278A

United States Patent [19]

Fukahori et al.

[11] Patent Number: 5,360,278

[45] Date of Patent: Nov. 1, 1994

[54] COLOR THERMAL PRINTER

[75] Inventors: Kenichi Fukahori; Shuji Sato; Masaki Shimoha, all of Kanagawa; Hideki Ito; Shin Iima, both of Tokyo; Mutsuko Narita, Kanagawa, all of Japan

[73] Assignee: Sony Corporation, Tokyo, Japan

[21] Appl. No.: 896,617

[22] Filed: Jun. 10, 1992

[30] Foreign Application Priority Data

Jun. 21, 1991 [JP] Japan ..... 3-150344

[51] Int. Cl.[5] ..... B41J 2/32

[52] U.S. Cl. ..... 400/120.01; 346/76 PH

[58] Field of Search ..... 400/120, 691, 692, 693, 400/694; 346/76 PH

[56] References Cited

U.S. PATENT DOCUMENTS

| | | | |
|---|---|---|---|
| 4,914,452 | 4/1990 | Fukawa | 400/120 X |
| 4,962,388 | 10/1990 | Quedens et al. | 400/120 X |
| 4,990,937 | 2/1991 | Tashiro et al. | 400/120 X |
| 5,001,498 | 3/1991 | Shimizu et al. | 346/76 PH |
| 5,023,628 | 6/1991 | Koch | 400/120 X |
| 5,085,533 | 2/1992 | Kitahara et al. | 400/652 |
| 5,101,222 | 3/1992 | Hakkaka | 346/76 PH |
| 5,118,208 | 6/1992 | Kitahara et al. | 400/56 |

FOREIGN PATENT DOCUMENTS

| | | |
|---|---|---|
| 0386919 | 9/1990 | European Pat. Off. . |
| 3935348 | 5/1991 | Germany . |

OTHER PUBLICATIONS

Patent Abstract of Japan vol. 12, No. 227 (M-713) (3074) 28 Jun. 1988 & JP-A63 25 056 (Hitachi Ltd) 2 Feb. 1988.

Patent Abstract of Japan vol. 8, No. 149 (M-308) (1585) 11 Jul. 1984 & JP-A-59 45 180 (Kanzaki Seishi K.K.) 13 Mar. 1984.

*Primary Examiner*—Edgar S. Burr
*Assistant Examiner*—Christopher A. Bennett
*Attorney, Agent, or Firm*—Ronald P. Kananen

[57] ABSTRACT

A thermal printer includes a chassis, a thermal head secured to the chassis and a platen roller which is rotatably supported in the chassis and movable relative to the thermal head. The platen roller is rotated by first platen driving mechanism, while being moved toward and away from the thermal head by second platen driving mechanism. When the platen roller is moved to contact with the thermal head via an ink ribbon intervened therebetween, a data or image is printed on a printing medium fed between the platen roller and the ink ribbon.

4 Claims, 9 Drawing Sheets

COLOR THERMAL PRINTER

BACKGROUND OF THE INVENTION

The present invention relates to a thermal printing apparatus.

Thermal printers are well known in the art wherein a thermal head is pressed against a platen roller via a sheet to print an image thereon. In order to release heat generated due to operation or energization of the thermal head, the thermal head is provided on its back side with a heat radiating fin. The thermal head pivotally moves around a shaft to be in and out of contact with the platen roller. Upon printing, the thermal head is sufficiently heated so that an image is printed on the sheet. Heat generated in the thermal head is radiated by the heat radiating fin within a housing of the apparatus. An example of such printing apparatus is shown in Japanese Utility Model Application First Publication No. 62-45145.

However, such a known printing apparatus employs a motor-driven cooling fan or the like in order to exhaust air, heated due to the heat radiation, from the apparatus housing. Therefore, the apparatus has a sufficiently large size to accommodate the cooling fan or the like therein, resulting in high manufacturing costs.

An object of the present invention is to provide a thermal printing apparatus which has a relatively small size but effects a high radiation efficiency.

SUMMARY OF THE INVENTION

According to the present invention, there is provided a thermal printing apparatus comprising a chassis having a bottom wall, a thermal head fixedly mounted in the housing for thermally printing data or image on a printing medium, a platen roller rotatably supported in the chassis and being movable relative to the thermal head. The apparatus also includes first platen driving means for rotating the platen roller in the chassis and second platen driving means for driving the platen roller so as to move toward and away from the thermal head, an ink ribbon receptacle means for accommodating an ink ribbon, and an ink ribbon feeding means for guiding the ink ribbon in the chassis to be passed between the thermal head and the platen roller. When the platen roller is moved by said second platen driving means to be brought into contact with the thermal head via the ink ribbon intervened therebetween while being rotated by the first platen driving means, the data or image is printed on the printing medium fed between the platen roller and the ink ribbon.

DESCRIPTION OF THE PREFERRED EMBODIMENT

Figure 1:
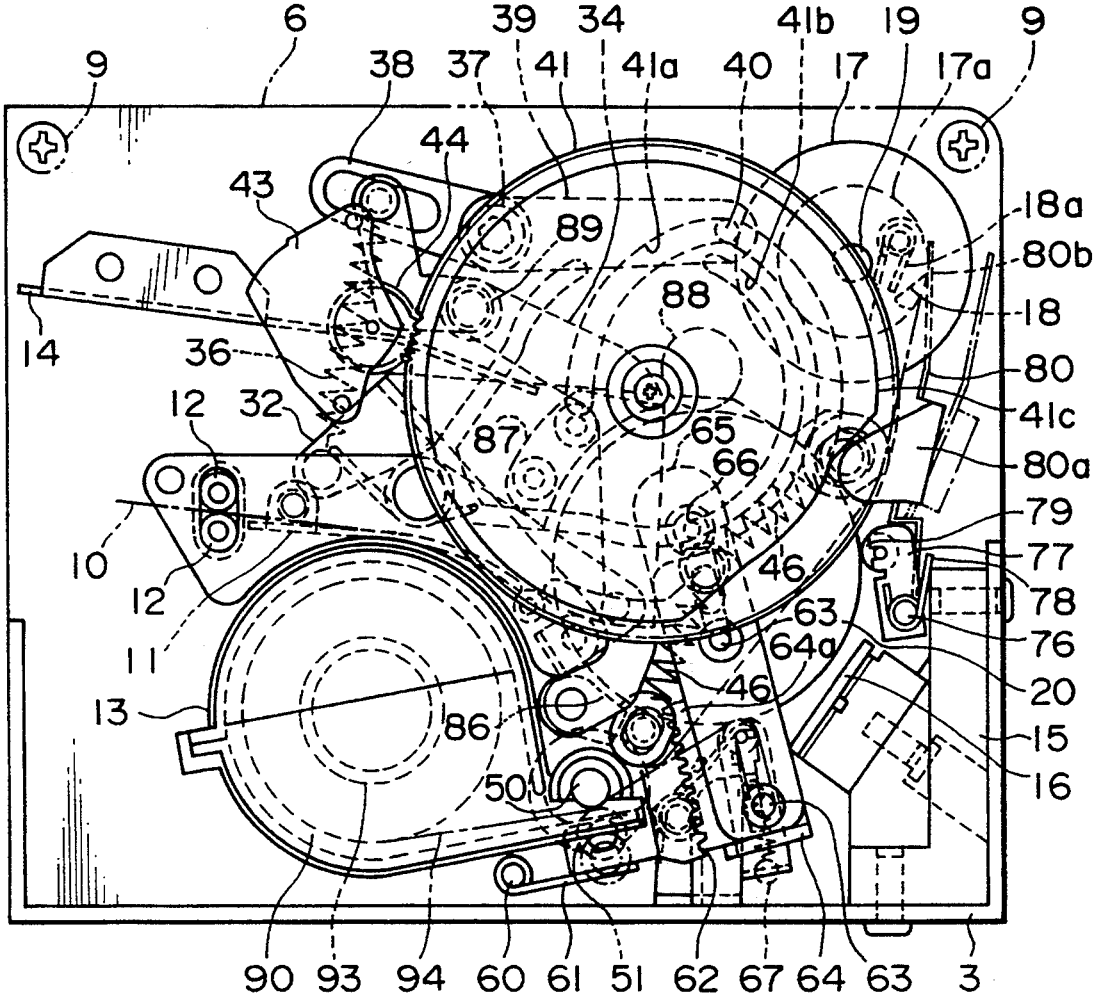
FIG. 1 is a right side view of a preferred embodiment of a color thermal printing apparatus according to the present invention.
Figure 2:
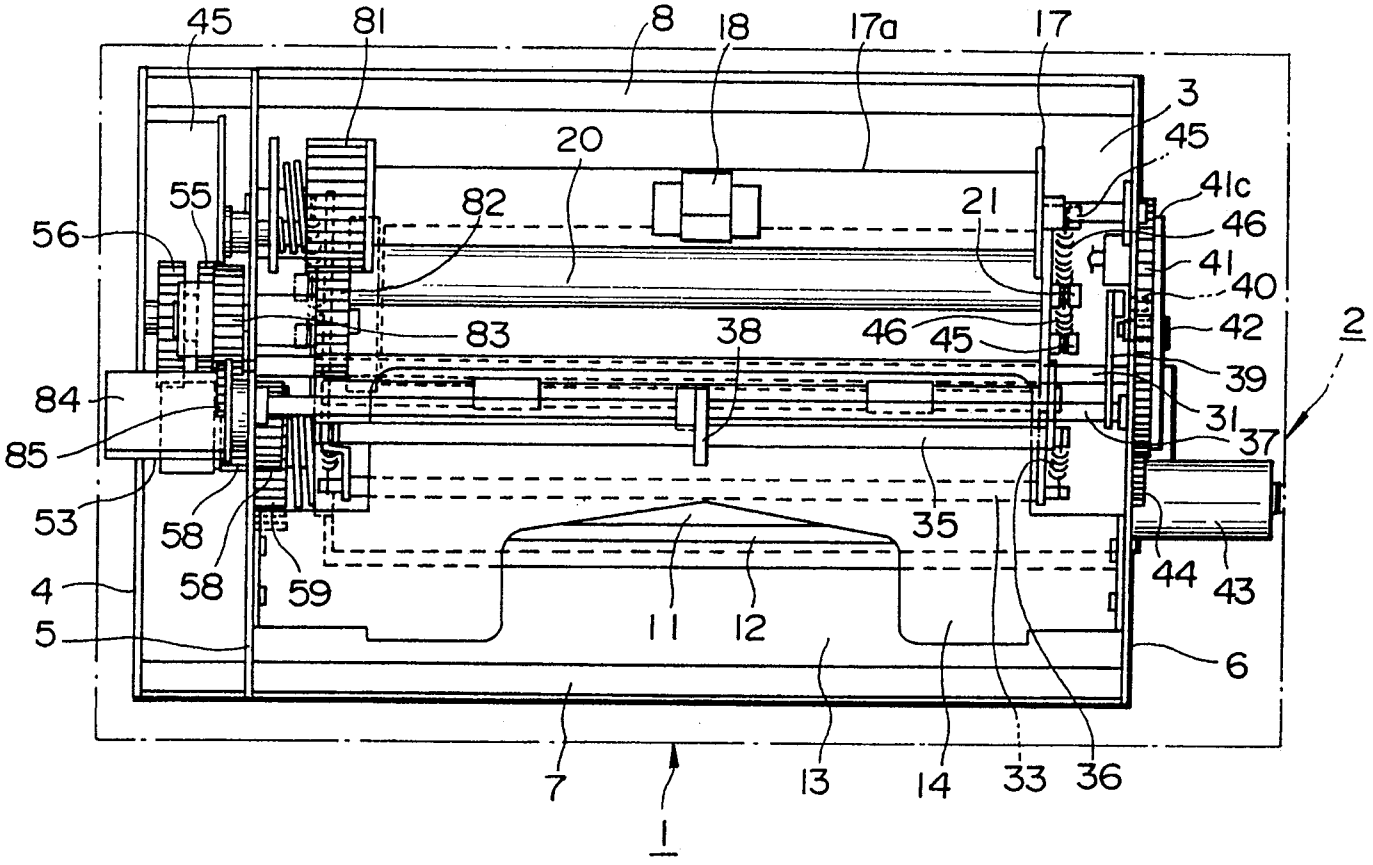
FIG. 2 is a plan view of FIG. 1.

Referring now to FIGS. 1 and 2, there is shown a preferred embodiment of a color thermal printing apparatus according to the present invention. As shown in FIGS. 1 and 2, the color thermal printing apparatus 1 includes a rectangular housing body 2, left and right side plates 4 and 6 disposed near opposite ends of the housing body 2, and a channel-shaped main chassis 3 connected at opposite ends thereof to the left and right side plates 4 and 6. The main chassis 3 has a bottom wall and front and rear walls oppositely and upwardly extending from the bottom wall. Between the front and rear walls of the main chassis 3 extends the left and right side plates 4 and 6. Supporting bars 7 and 8 are disposed between the left and right side plates 4 and 6 and tightened by screws 9. 9 thereto. A left inner plate 5 is disposed near and substantially in parallel with the left side plate 4 and extends between the front and rear walls of the main chassis 3.

As shown in FIG. 1, to the main chassis 3 is connected a sub-chassis 15 of a substantially "L" shape in lateral section so as to extend along a rear bottom corner portion of the main chassis 3. A thermal head 16 is secured to the sub-chassis 15 by set screws, upwardly inclining at a predetermined angle relative to the bottom wall of the main chassis 3 and longitudinally extending along the rear bottom corner portion of the main chassis 3. The sub-chassis 15 serves as a mount for installation of the thermal head 16. The main chassis 3 serves as a heat radiator which releases heat generated in the thermal head 16 from the housing body 2.

Figure 6:
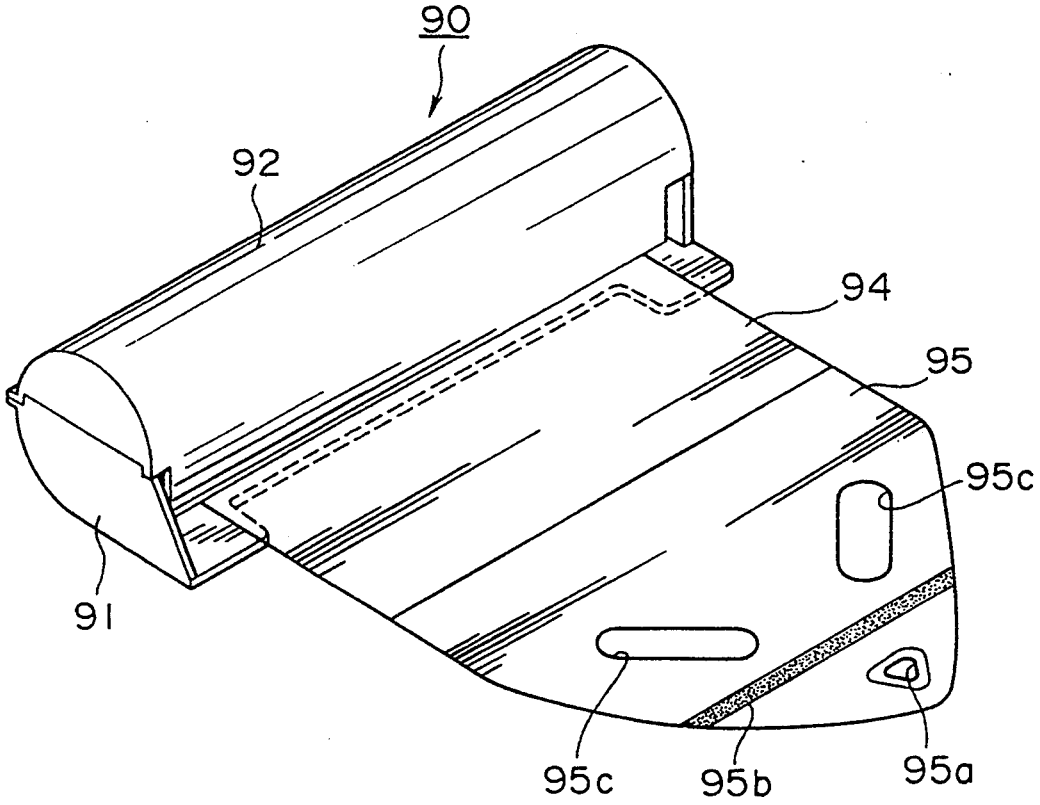
FIG. 6 is a perspective view of an ink ribbon cartridge for the apparatus of FIG. 1.

As shown in FIGS. 1 and 2, an ink ribbon cartridge receptacle 13 is disposed at a front portion of an internal space defined by the main chassis 3 and the left inner plate 5 and the right side plate 6. The cartridge receptacle 13 is of a substantially open-ended cylindrical shape and accommodates an ink ribbon cartridge 90 therein. The ink ribbon cartridge 90 comprises lower and upper casings 91 and 92 which are substantially semicylindrical halves as shown in FIG. 6. An ink ribbon reel 93 is rotatably mounted within the ink ribbon cartridge 90, as shown in FIG. 1. On the ink ribbon reel 93 is wound an ink ribbon 94 held in place by shoulders (not shown) which are formed on the ink ribbon reel 93. As seen in FIG. 6, the ink ribbon 94 is connected at its leading edge to a pull tab 95 which has a through-hole 95*a*, a line mark 95*b* and notches 95*c*, 95*c*. The line mark 95*b* is detected by a sensor (not shown) mounted in the housing body 2 so that an initial winding of the ink ribbon 94 around an ink ribbon take-up reel 17 as mentioned below is recognized. The notches 95*c*, 95*c* for restraining wrinkling on the ink ribbon 94 upon drawing the ink ribbon 94. The ink ribbon 94 has thereon continuous color regions to which colors of yellow, magenta and cyan are applied.

Figure 3:
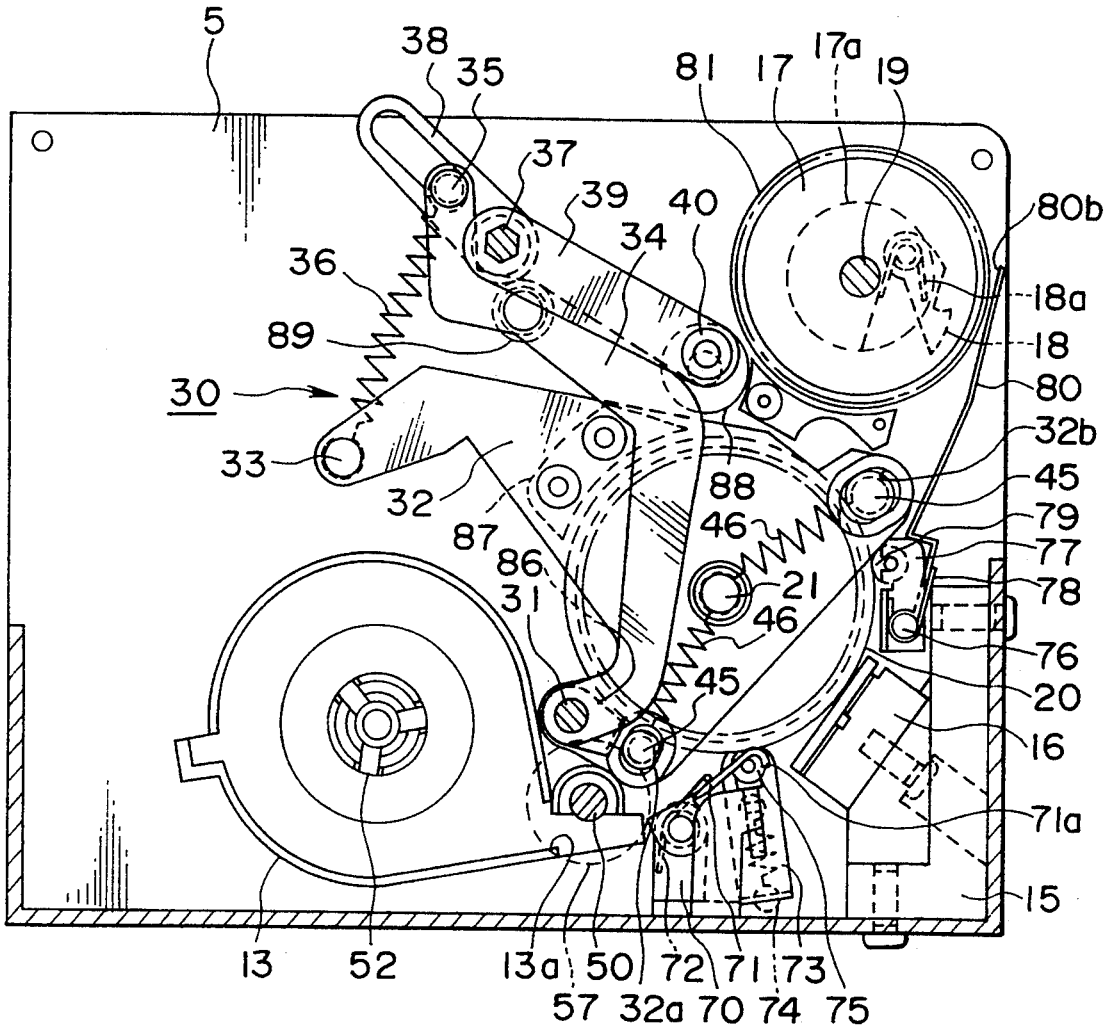
FIG. 3 is a sectional view taken from inside of a right side panel of the apparatus of FIG. 1.

As seen in FIGS. 1 and 3, the ink ribbon take-up reel 17 is disposed over the thermal head 16 in a rear portion of the internal space defined by the main chassis 3 and the left inner and right side plates 5 and 6. The ink ribbon take-up reel 17 is rotatably supported around a support rod 19 which is Journaled between the left inner and right side plates 5 and 6. The ink ribbon take-up reel 17 longitudinally extends and includes a cylindrical body portion 17a having at a mid-portion of its peripheral surface a recess in which a claw 18 of a substantially "L" shape in section is mounted so as to be enclosed therein. As shown in FIG. 3, the claw 18 is biassed by a spring 18*a* to project outwardly from the recess of the body portion 17*a* so as to be engaged with the through-hole 95*a* of the ink ribbon 94.

As best shown in FIG. 3, a cylindrical platen roller 20 made of a resilient material such as rubber is disposed between the ink ribbon take-up reel 17 and the ink ribbon cartridge receptacle 13 in a parallel relationship thereto. The platen roller 20 is driven by a platen driving mechanism 30 as shown in detail in FIGS. 3 and 5 so as to advance toward to contact the thermal head 16 and retreat therefrom.

As shown in FIG. 1, a sheet guide plate 11 for guiding a sheet 10 toward the platen roller 20 is disposed over the ink ribbon cartridge receptacle 13 on the front side of the platen roller 20. A pair of sheet guide rollers 12, 12 made of a resilient material are rotatably disposed on the front side of the sheet guide plate 11 so that the sheet 10 interposed therebetween is fed to the platen roller 20 by rotation of the sheet guide rollers 12, 12. A sheet discharge guide plate 14 is disposed over the sheet guide plate 11 and guides the sheet 10 travelled around the platen roller 20, and discharges it to the outside of the apparatus 1.

Figure 5:
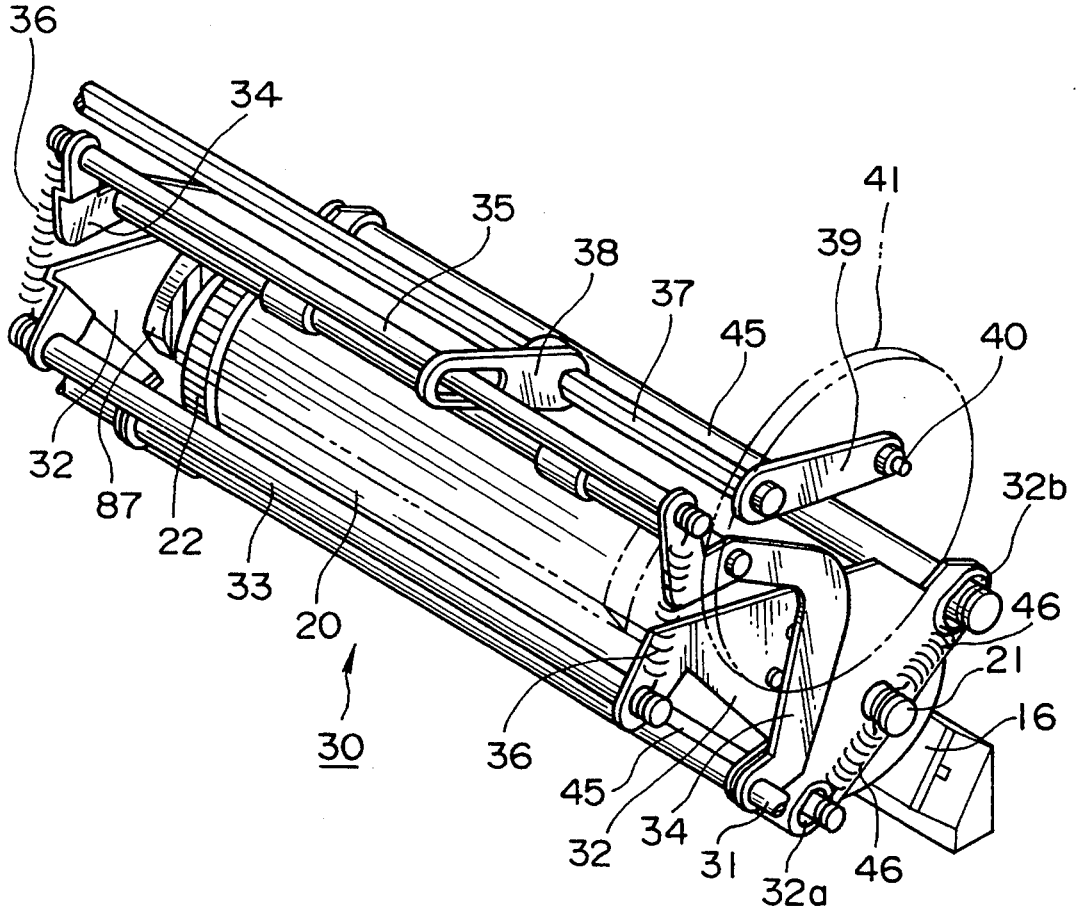
FIG. 5 is a perspective view of a platen driving mechanism of the apparatus of FIG. 1.

As seen in FIGS. 3 and 5, the platen driving mechanism 30 comprises a shaft 31 journaled on the left inner and right side plates 5 and 6, and left and right support arms 32, 32 which are rotatably supported by the shaft 31 in the housing 2. Between the left and right support arms 32, 32 is supported a shaft 21 of the platen roller 20 so that the platen roller is rotatably mounted on the support arms 32, 32. Each of the support arms 32, 32 is of a substantially triangular shape and has a triangular body portion and first to third protruding portions projecting outwardly at respective corners of the triangular body portion. The shaft 21 of the platen roller 20 extends through and beyond the triangular body portion of the support arms 32, 32 such that both ends thereof project slightly outwardly from the support arms 32, 32. Both end portions of the shaft 31 extend through the first protruding portion of the support arms 32, to the left inner and right side plates 5 and 6. The first and second protruding portions have elliptical holes 32*a* and 32*b*. Lower and upper pinch rollers 45, 45 extend substantially in parallel with the shaft 21 of the platen roller 20 and pass through two pairs of the aligned elliptical holes 32*a*, 32*a* and 32*b*, 32*b* opposingly formed on the supporting arms 32, 32, respectively. The lower and upper pinch rollers 45, 45 are supported in the holes 32*a* and 32*b* such that both ends thereof are slidable in a radial direction. The pinch rollers 45, 45 urge the sheet 10 against a circumferential surface of the platen roller 20. The both ends of each of the pinch rollers 45, 45 are connected via coil springs 46, 46 to the both ends of the shaft 21 projecting outwardly from the platen roller 20. The remaining third protruding portion of the support arm 32 which is spaced forwardly from the first and second protruding portions, supports a bar 33 extending in parallel with the shaft 21 of the platen roller 20. Substantially L-shaped sub-support arms 34, 34 are rotatably supported on both ends of the shaft 31 projecting from the support arms 32, 32. Each of the sub-support arms 34, :34 has one end mounted on the shaft 31 and the other end supporting a bar 35. Thus, the bar 35 passes through the sub-support arms 34, 34 and is securely supported at both ends thereof. The both ends of the bar 35 projecting from the sub-support arms 34, 34 are respectively connected via a coil spring 36 to the both ends of tin contact with the sheet 10 he bar 33 projecting outwardly from the support arms 32, 32.

Figure 4:
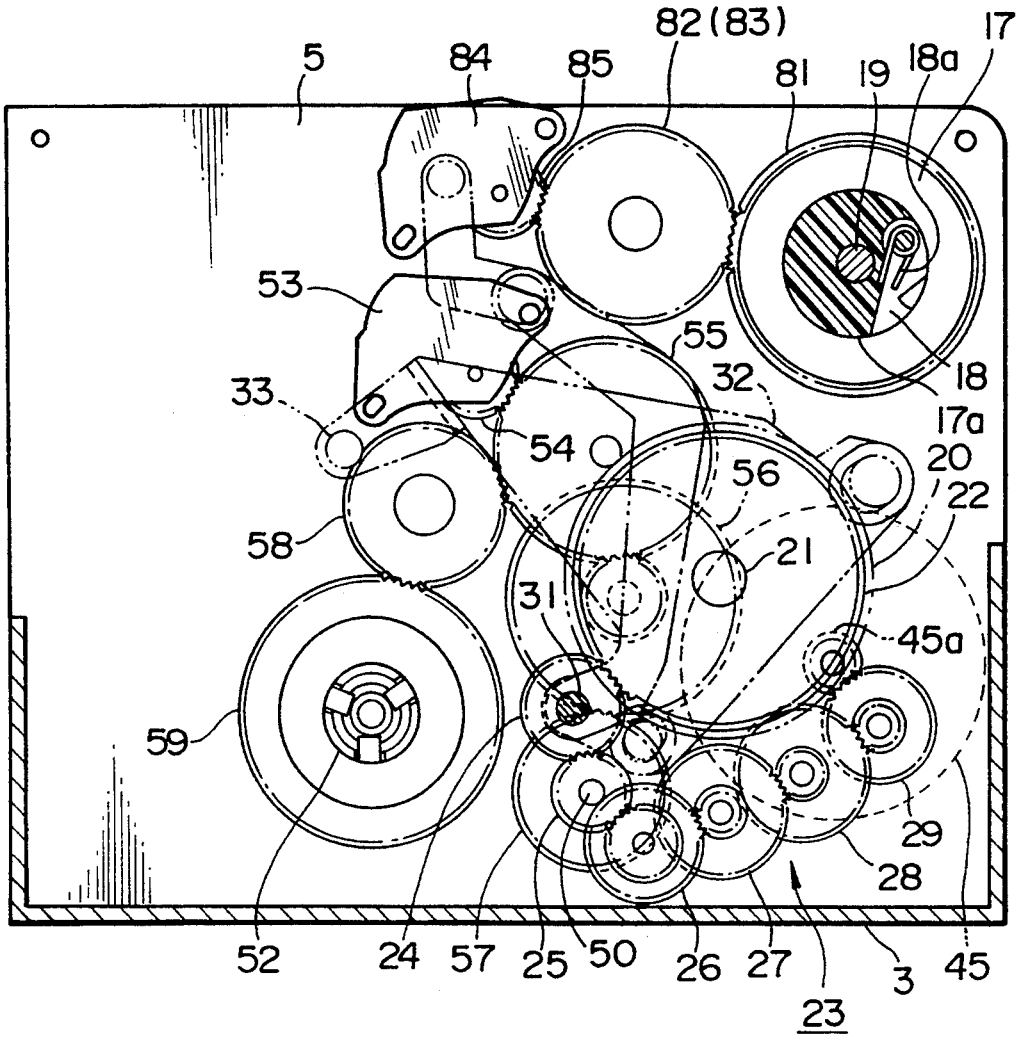
FIG. 4 is a schematic view showing a drive system of the apparatus of FIG. 1.

As seen in FIGS. 2. 3 and 5, the driving mechanism 30 includes a driving shaft 37 which is rotatably supported at both ends thereof by the left inner and right side plates 5 and 6 substantially in parallel with the bar 35 of the sub-support arms 34, 34. The driving shaft 37 and the bar 35 are connected to each other via an oval link member 38. The link member 38 has an end secured to a mid-portion of the driving shaft 37 and a tapered end having an elongated hole through which the bar 35 passes. A driving arm 39 is mounted on the driving shaft 37 adjacent and inside the right side plate 6. The driving arm 39 has one end secured to the driving shaft 37 and the other end provided with a pin 40 which extends outwardly therefrom so as to project from an outer face of the right side plate 6. On the outer face of the right side plate 6 is mounted a shaft 42 on which a cam gear 41 is rotatably supported (see FIGS. 1 and 2). As seen in FIGS. 1 and 2, the cam gear 41 has, on an 20 inner face thereof, a first cam groove 41*a* into which the pin 40 is fitted to act as a cam follower. The cam gear 41 is engaged with a driving gear 44 driven by a motor 43 which is secured to an upper portion of the outer face of the right side plate As shown in FIGS. 4 and 5, a gear 22 is secured to a left end face of the platen roller 20 which is opposed to an inner face of the left support arm 32. The gear 22 is operably associated with a gear group 23 which is arranged inside the left inner plate 5. The gear group 23 comprises first through sixth gears 24 to 29. The first gear 24 is rotatably supported on the shaft 31 of the support arms 32, 32 and engaged with the gear 22 fixed on the platen roller 20. The second gear 25 is rotatably supported on a capstan shaft 50 extending longitudinally and disposed over an inlet/outlet 13*a* of the ink ribbon cartridge receptacle 13 through which the ink ribbon 94 passes in and out (see FIG. 3). The second gear 25 is engaged with the first gear 24 and the third gear 26. The third to sixth gears 26 to 29 are rotatably supported on respective shafts disposed on an inner face of the left inner plate 5. The sixth gear 29 is engaged with a driving gear 45*a* disposed inside the left inner plate 5. The driving gear 45*a* is connected to a motor 47 secured to an outer face of the left inner plate 5, so that the gear group 23 is rotated via the driving gear 45*a* by the motor 45.

The thus-constructed platen driving mechanism 30 allows rotation of the platen roller 20 while moving toward and away from the thermal head 16.

As shown in FIG. 3, an ink ribbon supply reel mount 52 extends longitudinally and is rotatably supported on the left inner plate 5. The ink ribbon supply reel mount 52 and the capstan shaft 50 disposed over the inlet/outlet 13a of the ink ribbon cartridge receptacle 13 are rotated by means of a motor 58 mounted on the outer face of the left inner plate 5 as seen in FIG. 2. As shown in FIG. 4, a driving gear 54 is driven by the motor 53 and engaged with a first intermediate gear 55 disposed on the outer face of the left inner plate 5. Rotation of the first intermediate gear 55 is transmitted to a second intermediate gear 56 disposed on an inner face of the left side plate 4. The second intermediate gear 56 is engaged with a gear 57 secured to an end of the capstan shaft 50. As a result, the capstan shaft 50 is rotated by the motor 53. As shown in FIG. 2, intermediate gears 58, 58 are disposed on the inner and outer faces of the left inner plate 5, respectively. As shown in FIG. 4, the gear 58 on the outer face of the left inner plate 5 is engaged with the first intermediate gear 55 while the gear 58 on the inner face of the left inner plate 5 is engaged with a gear 59 secured to the ink ribbon supply reel mount 52. Thus the ink ribbon supply reel mount 52 is also rotated by the motor 53.

Referring now back to FIG. 1, a pinch roller 51 is disposed below the capstan shaft 50 extending substantially in parallel therewith. The pinch roller 51 is rotatably supported on an oscillating plate 61 longitudinally extending and pivoted around a shaft 60 which is supported at left and right ends thereof by the left inner and right side plates 5 and 6. The oscillating plate 61 is provided, at its right end, with an arcuate rack 62. The rack 62 is engaged with a rack 64*a* which is formed on a lower-front portion of a slider 64. The slider 64 is substantially vertically slidable along pins 63, 63 which are projecting inwardly from an inner face of the right side plate 6. A sliding plate 65 is overlaid on the slider 64 and substantially vertically slidable thereon along the pins 63, 63. The sliding plate 65 is provided, at an upper end portion thereof, with a pin 66 having both ends projecting therefrom inwardly and outwardly. An outward end of the pin 66 passes through the right side plate 6 so as to engage a second cam groove 41*b* which is formed on an inner face of the cam gear 41. On the other hand, an inward end of the pin 66 is connected to a lower end of the slider 64 via a compression spring 67.

As seen in FIG. 3, a bracket 70 is disposed on the bottom wall of the main chassis 3 so as to be positioned below the platen roller 20. An ink ribbon guide plate 71 is pivotally supported around a pin disposed on the bracket 70 and has a top end 71*a* biassed downwardly by a spring 72. To the bracket 70 is secured an ink ribbon lower guide 73 biased upwardly by a spring 74. The ink ribbon lower guide 73 is provided with an ink ribbon guide roller 75 which is rotatably supported at a top end of the ink ribbon lower guide 73. An ink ribbon upper guide 77 is rotatably supported on a shaft 76 over the thermal head 16 and has near a top end thereof an ink ribbon guide roller 79. The ink ribbon upper guide 77 is biased toward the platen roller 20 by a spring 78 so that the ink ribbon guide roller 79 is urged against the circumferential surface of the platen roller 20. Further, on the shaft 76 is rotatably supported an ink ribbon guide control plate 80 which has a distal end portion 80*b* and a protruding portion 80*a* at a lower-right portion thereof as shown in FIG. 1. The ink ribbon guide control plate 80 is biased toward the body portion 17*a* of the ink ribbon take-up reel 17 by a spring (not shown). The protruding portion 80*a* cooperates with a circumferential face of a cam projection 41*c* projecting outwardly from an outer face of the cam gear 41. The circumferential face of the cam projection 41*c* is formed with a recessed portion. When the protruding portion 80*a* is placed in the recessed portion, the distal end portion 80*b* contacts the body portion 17*a* of the ink ribbon take-up reel 17. Upon being placed on non-recessed portion of the circumferential face of the cam projection 41*c*, the distal end portion 80*b* is separate from the body portion 17*a* of the ink ribbon take-up reel 17.

As shown in FIGS. 2, 3 and 4, a gear 81 is secured to a left end of the ink ribbon take-up reel 17 and engaged with one gear 82 of a pair of gears disposed inside and outside the left inner plate 5. The other gear 83 disposed outside the left inner plate 5 is engaged with a driving gear 85 driven by a motor 84 which is disposed on the outer face of the left inner plate 5. In FIG. 3, numerals 86 and 87 indicate sheet guide plates made of synthetic resin and numerals 88 and 89 indicate sheet discharge rollers for feeding out the sheet travelling over the platen roller 20.

OPERATION

Figure 7:
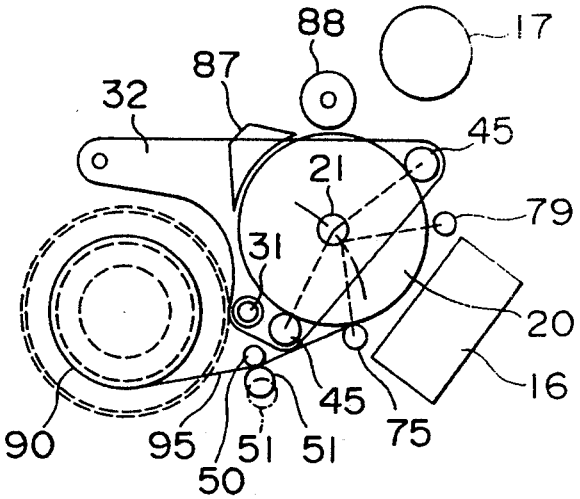
FIG. 7 is a schematic view showing a ink ribbon cartridge mounting state of the apparatus of FIG. 1.

Before starting a printing operation, the ink ribbon cartridge 90 is set in the ink ribbon cartridge receptacle 13. As shown in FIG. 7, the pinch roller 51 moves toward the capstan shaft 50 so that the pull tab 95 of the ink ribbon 94 derived from the ink ribbon cartridge receptacle 13 is urgedly interposed therebetween. As the capstan shaft 50 is rotated, the pull tab 95 is allowed to move toward the platen roller 20.

Figure 8:
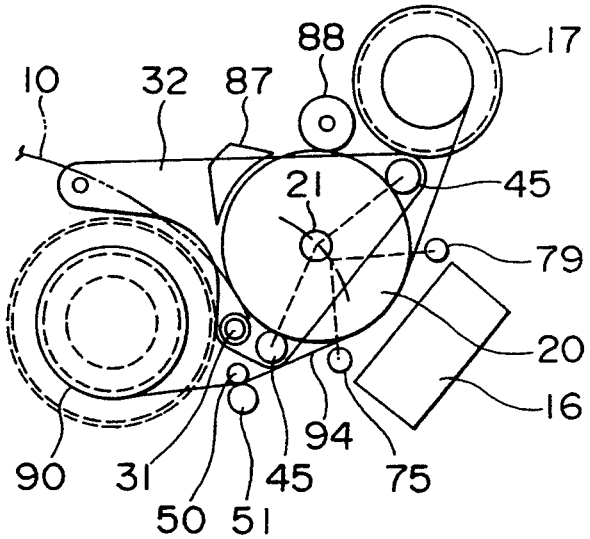
FIG. 8 is a schematic view showing a sheet feeding state of the apparatus of FIG. 1.

As shown in FIG. 8, upon rotation of the platen roller 20, the pull tab 95 further moves toward the ink ribbon take-up reel 17. The distal end portion 80*b* of the ink ribbon guide control plate 80 contacts the body portion 17*a* of the ink ribbon take-up reel 17 so that the pull tab 95 is urged on the body portion 17*a*. Then, the through-hole 95*a* of the pull tab 95 is engaged with the claw 18 of the body portion 17*a* so that the ink ribbon 94 is led to the ink ribbon take-up reel 17 and wound up thereon. The sheet 10 is supplied from the sheet guide plate 11 and urged against the platen roller 20 by the lower pinch roller 45.

Figure 9:
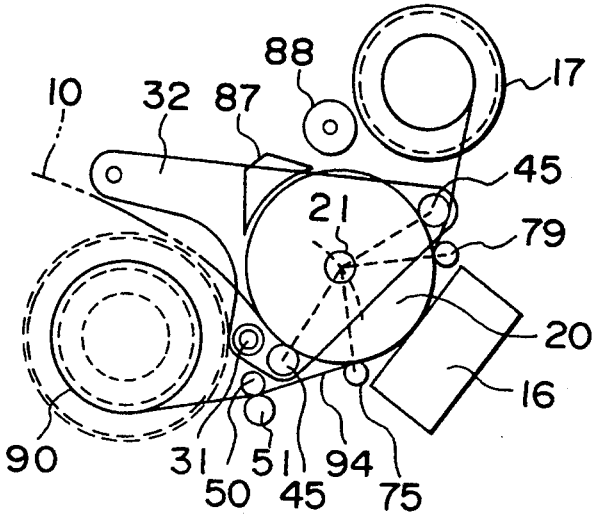
FIG. 9 is a schematic view showing a printing state of the apparatus of FIG. 1.

Subsequently, as shown in FIG. 9, the platen roller 20 is moved toward the thermal head 16 so as to be urged thereon via the ink ribbon 94, by the platen driving mechanism 30. As the platen roller 20 rotates, the sheet 10 on the platen roller 20 is fed to the upper pinch roller 45 while being urged against the ink ribbon 94. Thus, printing is performed on the sheet 10 in one, e.g. yellow, of the colors applied onto the ink ribbon 94.

Figure 10:
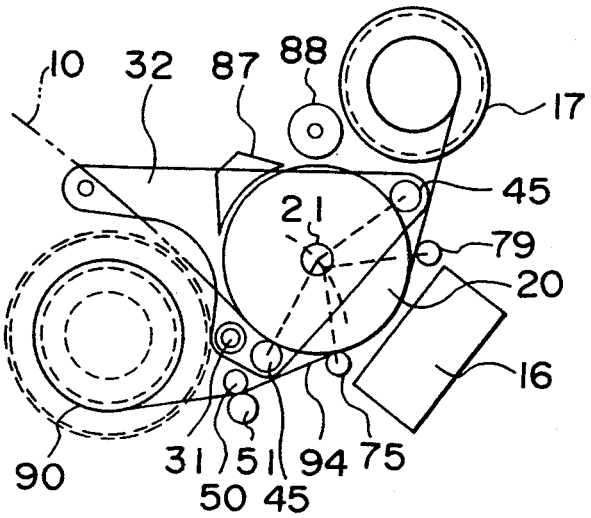
FIG. 10 is a schematic view showing a sheet reverse feeding state of the apparatus of FIG. 1.
Figure 11:
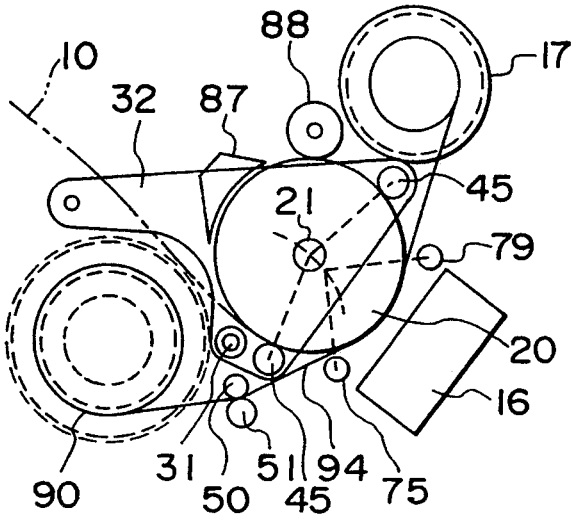
FIG. 11 is a schematic view showing a ink ribbon feeding state of the apparatus of FIG. 1.

As shown in FIG. 10, the platen roller 20 is moved away from the thermal head 16 by the platen driving mechanism 30 and rotated in reverse until the leading edge of the sheet 10 reaches the lower pinch roller 45. Subsequently, as shown in FIG. 11, the ink ribbon 94 is fed toward the ink ribbon take-up reel 17 before subsequent printing by another color. e.g. magenta, on the ink ribbon 94.

Printing by the last color, e.g. cyan, is finished by repeated operations as shown in FIGS. 8 to 11.

Figure 12:
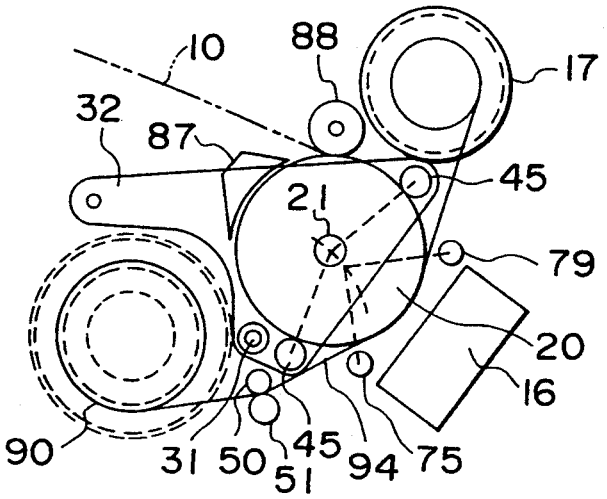
FIG. 12 is a schematic view showing a sheet discharging state of the apparatus of FIG. 1.

As shown in FIG. 12, after printing by all the colors, the platen roller 20 is moved away from the thermal head 16 and rotates forward so that the sheet 10 is fed onto the sheet discharge guide plate 14.

In such a case that all the ink ribbon 94 is derived from the ink ribbon take-up reel 17 or the ink ribbon cartridge 90 should be replaced, the ink ribbon 94 is rewound up on the ink ribbon reel 93 of the ink ribbon cartridge 90 before removing the ink ribbon cartridge 90 from the ink ribbon cartridge receptacle 13. Upon rewinding the ink ribbon 94, the distal end portion 80*b* of the ink ribbon guide control plate 80 is urged against the ink ribbon 94 wound on the body portion 17*a* of the ink ribbon take-up reel 17. As a result, the ink ribbon 94 is sufficiently tensioned in a direction reverse to rewinding direction such that the ink ribbon 94 is prevented from being loosened.

The thermal printing apparatus according to the present invention may be employed with a detachable sheet tray member for holding a plurality of sheets for an automatic feed operation, instead of the sheet guide plate 11.

As is obvious from the above description, the main chassis 3 mounting the thermal head 16 serves as a heat radiating member to provide heat radiation at a high efficiency. Accordingly, a motor-driven cooling device such as cooling fans can be omitted in the thermal printing apparatus, so that the thermal printing apparatus can be reduced in size and manufacturing costs; therefore, the installation space becomes small.

What is claimed is:

1. A thermal printing apparatus comprising:

a housing including a chassis having a bottom wall;

a thermal head fixedly mounted in said housing for thermally printing data or image on a printing medium and at a location where said chassis serves as a heat radiator which releases heat generated in the thermal head;

a platen roller rotatably supported in said chassis and being movable relative to said thermal head;

first platen driving means for rotating said platen roller in said chassis;

second platen driving means for reciprocally driving said platen roller so as to move toward and away from said thermal head;

an ink ribbon receptacle means for defining an ink ribbon space for accommodating an ink ribbon; and an ink ribbon feeding means cooperating with said first and said second platen driving means for guiding an ink ribbon in said chassis to be passed in said ink ribbon space between said thermal head and said platen roller;

wherein when said platen roller is moved by said second platen driving means into contact with said thermal head with an ink ribbon intervened in said ink ribbon space located therebetween while being rotated by said first platen driving means, said thermal head prints the data or image on the printing medium located between said platen roller and said ink ribbon;

a sub-chassis which is secured to said chassis, and on which said thermal head is mounted; and wherein said sub-chassis is substantially L-shaped in lateral section and positioned so as to extend along a rear bottom corner portion of said chassis.

2. A thermal printing apparatus as claimed in claim 1, wherein said thermal head is disposed at an angle with respect to said bottom wall of said chassis.

3. A thermal printing apparatus as claimed in claim 2, wherein said platen roller is supported through arm members by a pivot axis such that pivotal movement of said platen roller about the pivot axis causes said platen roller to be brought into contact with said thermal head via an ink ribbon and the printing medium.

4. A thermal printing apparatus as claimed in claim 3, wherein said pivotal movement of the platen roller about the pivot axis is caused by said second platen driving means.

* * * * *